US011585079B2

(12) United States Patent
Cencer

(10) Patent No.: US 11,585,079 B2
(45) Date of Patent: Feb. 21, 2023

(54) METHOD TO ENHANCE SOLIDS AND LIQUIDS FLOW THROUGH A STORMWATER CONTAINMENT VOLUME

(71) Applicant: Daniel George Cencer, Bacliff, TX (US)

(72) Inventor: Daniel George Cencer, Bacliff, TX (US)

( * ) Notice: Subject to any disclaimer, the term of this patent is extended or adjusted under 35 U.S.C. 154(b) by 0 days.

(21) Appl. No.: 17/303,835

(22) Filed: Jun. 9, 2021

(65) Prior Publication Data

US 2022/0396945 A1 Dec. 15, 2022

(51) Int. Cl.
*E03F 5/00* (2006.01)
*E03F 5/10* (2006.01)

(52) U.S. Cl.
CPC ..... *E03F 5/105* (2013.01); *E03F 5/10* (2013.01)

(58) Field of Classification Search
CPC ..... E03F 5/10–106
See application file for complete search history.

(56) References Cited

U.S. PATENT DOCUMENTS 2,050,798 A * 8/1936 Kothe ..... E04B 1/7023 52/62
4,268,993 A * 5/1981 Cunningham ..... E01C 13/083 405/37
8,734,049 B1 5/2014 Stiles
2011/0135393 A1* 6/2011 Dudding ..... E02D 31/006 405/129.6

OTHER PUBLICATIONS

Drawing titled, "Truegrid Gravel, Fill Installation, Heavy Load", published online at TRUEGRIDPAVER.com.
Webpage titled "Case Study—New Braunfels Storage" URL: https://www.truegridpaver.com/case-studies/new-braunfels-storage/ First save at archive.org was Sep. 22, 2020.
Webpage titled "Case Study—Autonation" URL: https://www.truegridpaver.com/case-studies/autonation/ Saved for first time at archive.org Aug. 19, 2017.
Webpage titled "North America's Largest BMX Bike Park" https://www.truegridpaver.com/case-studies/north-americas-largest-bmx-bike-park/ Saved at archive.org on Sep. 18, 2020.

* cited by examiner

*Primary Examiner* — Janine M Kreck

(57) ABSTRACT

A method to enhance the ability of a stormwater containment volume to flow and flush solids and liquids. Implemented by depositing rock into shaped piles formed at the rock's angle of repose, the resultant inclined surfaces are covered with suitable waterproof material and covered with more rock up to the top surface. Stormwater flushes solids deposited on the surface downward into the volume where they contact the inclined surfaces. Water and solids flow down the inclined surfaces at increased velocity toward collection drainpipes at their base. Because sediment flows into drainpipes, it does not flow to the bottom of the volume or become stagnant or reduce the volume's capacity. This creates a low-cost stormwater containment system that can support vehicle travel on its surface, requires no concrete or sewers, is self-cleaning, accessible for cleaning, or both, and does not require human access to the bottom surface for maintenance.

64 Claims, 10 Drawing Sheets

METHOD TO ENHANCE SOLIDS AND LIQUIDS FLOW THROUGH A STORMWATER CONTAINMENT VOLUME

CROSS-REFERENCE TO RELATED APPLICATIONS

No related patents have been filed.

STATEMENT REGARDING FEDERALLY SPONSORED RESEARCH OR DEVELOPMENT

No Federal funds were used for research for this patent.

THE NAMES OF THE PARTIES TOA JOINT RESEARCH AGREEMENT

Not applicable.

SEQUENCE LISTING

Not applicable.

STATEMENT REGARDING PRIOR DISCLOSURES BY AN INVENTOR OR JOINT INVENTOR

Inventor has no prior disclosures related to the present invention.

BACKGROUND OF THE INVENTION

Field of The Invention

The technical field of the invention is stormwater management, and in particular underground stormwater management systems.

Background

Stormwater Management Problems Continue Due to Climate and Development Pressures Stormwater management problems increase in areas where environmental and man-made factors combine to produce more frequent and more intense occurrences of flooding. In the USA, the Federal Emergency Management Agency, working with local governments, has been redrawing the '100-Year' (one-percent risk of flooding occurring per each year) floodplain boundaries to include more area and locales never before defined as being at risk for flooding.

Flooding risk is increasing due to continued development that strains existing, often already inadequate stormwater control infrastructure. Infrastructure improvements have been inadequate to handle the increase in stormwater volumes. In the USA, catastrophic events have occurred in recent years due to lack of stormwater containment in critical areas. Upstream development increases ground-covering concrete as new buildings and roads divert increasing amounts of stormwater from infiltration into local grounds.

In addition, changes in climate are causing increased rainfall amounts and frequency. Rainfall levels that were once considered to be of one-percent probability in any given year are now happening only a few years apart. Increased flooding events and rising water levels have caused authorities to markedly increase stormwater detention or retention volume requirements for new development projects so as to reduce river and bayou levels during storm events. Increasing containment volume requirements pose greater challenges to developers as new systems must hold much larger volumes of stormwater than ever before.

Stormwater containment systems are often required for new developments by flood regulating authorities such as municipalities, flood control districts or state departments of transportation. The volume a new system must hold is calculated based on regional rainfall amounts, soil types, area covered by development and percent that area that is impermeable (covered with concrete, or buildings, etc.). Design rainfall amounts are based on the probability of storm the size that is only expected once every 5, 10, 20, 50 or 100 years (depending on the regulating authority). Analyses assume this storm happens over a short time span (1-3 hours), and if storing the water from a 50-year or 100-year storm is the design criteria, a large influx and total volume of water into the system will need to be handled.

How Regulatory Actions Are Affecting Project Development and Operating Economics Some authorities require that new developments build the maximum amount of reserve capacity that can be assigned using mandated methods of calculating rainfall amounts and runoff percentages. Worst-case assumptions for all parameters define substantial volumes that are increasingly difficult to accommodate. Required rainfall depths of over one foot are imposed in some coastal areas where amounts are historically high. When multiplied by the total area of a development to get a resultant volume of required storage, one can see the potential for very large storage requirements.

This penalizes new project developers who must reserve more area than ever before for stormwater containment. These increased requirements create a large burden on new development which has to pay the costs that recur throughout the system's lifetime. Volume requirements for newly-developed unlined ponds are being seen to be 25% of the total area of a project. Increased property values can make the cost of land to use for ponds prohibitive and affect the economic proposition of development. Profit margins of the new business may not be large enough to pay for the loss of use of 25% of the land. In such cases the development would become unfeasible.

Stormwater Management Systems Basic Description, Terms and Function

Stormwater containment systems can be above-ground or underground. They are designed to act either as detention systems or retention systems. Detention systems are storage volumes designed to collect, then temporarily buffer the stormwater while continuously metering flow out via an outfall system. Detention systems usually do not have the ability to allow water to infiltrate into the ground beneath them as the contents are anticipated to be gone within two days via the outfall. Retention systems are designed to keep at least some stormwater for a period and not allowed to flow to an outfall. Retention systems often have the ability to allow stormwater to infiltrate into the ground.

An outfall is the subsystem that receives stormwater outflow from a storage volume and directs it downstream to successively larger drainage conduits until it reaches a large body of water such as a bay, river, gulf, or ocean. Along a road, there may be drainage ditches that fulfill this role for development adjacent to the road.

The capability of downstream infrastructure to accept water from a system is the prime consideration when determining a new system's outflow rate. To control the new development's ability to flow water into the downstream system, a flow-metering orifice is usually in the outfall pipe to restrict the maximum outgoing flowrate. This set rate is commonly that which would occur if the land was still in its pre-developed state.

Above-Ground Systems

Above-ground systems are primarily open ponds. Ponds may or may not be lined with impermeable fabric called 'geomembrane'. Permeability of the pond bottom allows infiltration of the water back into the ground, but liners will prevent sand and soil from mixing into the water, reduce organic growth and improve its ability to be cleaned.

An unlined pond's effective depth is limited by groundwater conditions and the underground water table, as stormwater can only be added above the water table level. If the pond is constantly partially filled, its capacity for detaining or retaining stormwater is calculated from that level, and not the pond bottom. All ponds require periodic maintenance to keep them clean, relatively free of grass and weeds, and preserve their design depths.

The biggest advantage of an above-ground system is that it is commonly the lowest-cost type to implement if the required space is affordable and available. Ponds are best suited for developments where purchase cost of additional land used for the system is not prohibitive and reduced economic benefits from using the land for non-revenue purposes can be offset by other methods. Construction details can vary and affect the total cost greatly. Concrete-lined ponds cost more than geomembrane fabric lined systems (but can usually be made deeper and are easier to maintain). Unlined versions are the least cost to build.

Above-ground system disadvantages include the aforementioned land purchase cost and loss of use of land for revenue-making purposes. This affects the end-user of the developed site if that user must pay extra to offset this increased cost to develop. All systems require maintenance to maintain proper function. Above-ground systems require added work to maintain their appearance. This includes removal of weeds and growth in the water (if standing), extra grass to mow, etc. At worst case is the cost to maintain capacity level by periodic dredging. Few systems are maintained so accurately such to have that level of maintenance performed. Most are not monitored closely for volume reduction over time.

Ponds require considerably more land than what is actually used for stormwater storage. Pond design requirements stipulate a 30-degree slope banking all around to prevent degradation. This bank extends outward enough to exceed the maximum design height of stormwater by a prescribed amount (around a foot). Outside of that is a berm of minimum ten feet in width to facilitate maintenance of the pond all around its perimeter. A fence sits outside of the berm to protect against unauthorized entry and increase public safety.

Above-ground ponds can be difficult to retrofit to an existing property unless the needed land is available at reasonable cost. Ponds are not allowed in some areas (e.g., urban areas) due to land use restrictions. Poorly maintained ponds can have unsightly appearance, their water is usually turbid, and they can be breeding ground for mosquitoes.

In areas with high underground water tables, the depth of ponds not designed to be lower than the ground water table (i.e. concrete-lined) will be limited. To reach required storage volumes, greater surface areas are required. Concrete-lined ponds extending to lower depths might require pumping systems to raise water high enough to enter the outfall and flow away. These systems are obviously higher in cost.

Underground Systems

Because underground systems can generally store more volume per surface area than above-ground systems, they find more applications where the cost of land is higher or available land is limited. Higher system costs can also mean the resultant occupying business paying for the system's development must operate at higher profit margin to afford the costlier option. Land-use and zoning laws that apply to the development location may force the choice as well. Some urban areas may not allow above-ground ponds or restrict use of the surface to certain activities.

An underground system can retrofit to or redevelop a location to provide its first or additional stormwater storage capacity. Such a system might be the 'only solution' for some projects limited by available space, in an urban area, surrounded by existing buildings, etc. The depth and resultant volume are usually limited only by project funds.

Underground Systems—'High Cost'

Underground systems are of various types that can be classified as one of three descriptions: 'High-Cost', 'Medium-Cost' and 'Low-Cost'. 'High-Cost' designs include deep, concrete-lined vaults with pumping and filtration systems as well as inspection tunnels that provide human access to clean and inspect them. Workers must periodically venture underground and flush out sediment and sand deposits with pressurized water streams.

These concrete-lined vaults are often a story deep and are built strong enough to provide use of the top surface for building on or vehicle travel, even heavy trucks. This dual use of the land requires high initial costs but returns lower business expenses and property taxes for the life of the system.

Concrete vaults have drawbacks. They are costly to design, engineer, build and maintain. Heavy excavation is required to build them. Much concrete is used in their construction. Pre-cast concrete components are often used for the top surfaces, beams and walls. Once complete, costly pumping, filtration, cleanout-access systems are required for the life of the constructed system.

Underground Systems—'Medium Cost'

'Medium-Cost' systems include specially-designed, molded plastic boxes that stack and join to form clear volumes. They sit in, and are covered with geomembrane fabric to produce watertight compartments. They have high ratios of free volume to structure but are expensive to purchase and install. Similar systems are made from full or partial arches or tubes several feet in diameter covered with geomembrane fabric to create watertight 'caverns' to hold water. These types of systems use gravel around the structures to fill voids between them and the walls of the system. Surface load-carrying ability of these systems are limited, and surface use is usually limited to pedestrians and green spaces. Installed depths required to achieve high surface loading can be prohibitive.

Medium-Cost systems like these use much less concrete than High-Cost underground systems. Concrete (or asphalt) is needed to cover the top surface to collect stormwater and concrete to create sewer pipes that take the stormwater to the filtration system prior to flowing it into the storage volume. These systems require less cost to engineer, purchase, and install.

These systems also have drawbacks. Like High-Cost systems, they require manned cleaning crews to access the underground volumes and spray water on surfaces to flush sediment and solids to point of collection and remove it manually. They require periodic manual cleanout of the pre-entry filter inside a sewer entrance to the storage system.

The total cost of these systems include the storage system, the sewer system, the pavement overhead, underground filtration system, and possibly a pumping system. Regular maintenance requires workers to go underground into the volumes to clean them. These systems are not suitable for shallow depths. The actual depths used may require pumping water up and out to remove.

They may not be compatible for locations with high water tables or require considerable amounts of additional gravel fill to keep a system from being pushed up from the ground. Some systems will not withstand vehicular traffic, others require installed depths of 20 feet below surface to withstand vehicle loads.

Underground Systems—'Low Cost'

One such underground system that does not use expensive devices is the underground rock bed storage volume. These are the lowest-cost underground systems. These systems are nominally a flat-bottomed pit dug into the ground, lined with geofabric or geomembrane, and filled with rock conforming to a suitable size range. Broken concrete or asphalt pieces can also be used for at least part of the fill volume, but most systems are homogeneous gravel. Lining prevents sand and sediment infiltration into the rock. They are usually equipped with a drainage pipe system at their bottom that flows stormwater to an outfall with metering orifice. The bottom is mostly or completely flat to prevent sudden downpours from quickly filling the volume, flowing to one end and overflowing the retaining wall. Flat bottom surfaces also mitigate the need to dig deeper to obtain the same storage volume.

Rock bed storage systems do not rely on volume-creating devices like boxes, or tubes, but instead only utilize the approximately 40 percent open volume naturally occurring within many types of piled rocks to store water. Systems with storage depths of up to six feet have been constructed. Rock bed systems generally do not have concrete or asphalt-paved top surfaces above them to channel the stormwater to a drain system. Instead, they may use either a device called a permeable paver, or nothing at all. This allows stormwater to enter the system across the entire surface area of the storage volume and precludes the expense of concrete surfaces and sewer systems.

Permeable paver grids are flat, interlocking parts made of molded plastic. They are designed to cover rock bed systems or soil to improve surface stability and provide some filtration of large debris. With molded pockets subsequently filled with a smaller gravel than that used in the storage volume, they stabilize the top surface of the system. They withstand the heaviest vehicles and equipment driving over them with no shifting of the rocks beneath. They are generally around two inches in height and two to four feet square. Water flows easily through the permeable pavers and directly into the rock bed for storage. Such rock bed systems with pavers on top are especially suited for use as driveway and parking lot as well as a stormwater collection and storage system.

Because there is no collection and filtration system acting on the stormwater, it carries sand, sediment, dust and organic debris into the storage volume. Solid particles will be blown onto the surface of a rock bed system by prevailing winds or dropped by vehicle traffic. Adjacent water flow might carry sand and debris into the system. The smaller surface rock installed in paver grids acts as a filter for solids, soil, leaves, organic matter too large to pass through it. To clean them, permeable pavers require periodic vacuuming of solids, soil, leaves and organic matter from the surface. Vacuum cleaning is only effective in cleaning the pavers' two-inch depth, and does not remove soil, sand or sediment small enough to pass through the pavers' gravel. Those substances will pass into the rock bed volume.

Rock bed systems without permeable pavers can also be driven on by traffic. Periodic regrading restores the top surface. As with permeable pavers on the surface, their surfaces can be vacuumed to remove organic debris, but vacuum cleaning has limited effectiveness, and there will always be sediment and solids washed into the storage volume.

As stated, these systems are the least expensive to design, purchase, and construct. They can be engineered to install at depths lower than water table because volumetric density of rock bed is greater than displaced water around it. They do not require concrete to cover them and can even use recycled concrete or asphalt pieces in the storage volume when broken into suitably sized pieces. The absence of concrete also makes the systems themselves more easily dismantled and recycled to create new systems at new locations.

They are easier to maintain than other underground systems to the extent they can be maintained. The limitation is that these systems can't be adequately cleaned unless they are taken completely apart (with the rock bed dug up and flushed clean). This is an underground rock bed system's greatest drawback, and for some (but not all) regulatory authorities it is a terminal fault that causes their disallowance for permitting in their areas of control. In fact, because of this inability to be cleaned (in a reasonable, realistic manner) or self-clean, the Texas Department of Transportation (TxDOT) refuses to permit underground rock bed storage systems to be used as a method for stormwater retention for new developments under their control.

Simply designing a new rock bed system to have excess capacity at commissioning and allowing it to reduce over time is not an acceptable solution to TxDOT. I discovered one reason for their position is the lack of an established design method to predict the amount of solids expected to infiltrate a system over time. Incoming amounts will vary by geographic locale, climate, weather patterns, physical proximity to structures, trees, undeveloped adjacent ground, etc. Further, the state of reduced capacity of existing rock bed systems cannot be determined without partial excavation. TxDOT assumes the life of a stormwater storage system is indefinite, and maintenance, which is the responsibility of whoever owns it, will need to be done on a periodic basis to maintain its performance. They feel the likelihood of an owner at any point to completely excavate the rock bed to clean it is extremely low.

Because the floor of existing underground rock bed systems are flat or nearly flat, fine solid matter flows down to the bottom of the rock bed volume and collects around the rocks at the bottom. It then stays there and does not flow to the outfall pipe. The potential for water flow toward a drainpipe from areas all around it is small, and the horizontal flow drawn from around rocks is not enough to keep sand and sediment in suspension and moving. This accumulation will accrue, displacing the water storage capacity, and eventually render the system inadequate to meet its design requirement.

SUMMARY OF THE INVENTION

The embodiments provide a method to enhance the ability of a volume to flow and flush solids and liquids. They are implemented by placing and shaping material of one or more types suitable for filling the volume to create at least one surface inclined at an angle from horizontal, then covering part or all of the inclined surface with one or more layers of a semipermeable or impermeable material. The angle from horizontal may be established by the angle of repose for the particular material being used. The material suitable for filling the volume can be comprised of discrete pieces which are a combination of solid, porous, or hollow. Further, this material can be rock, stone, concrete, asphalt, brick, hollow or solid man-made objects, or a mixture of these.

The semipermeable or impermeable material covering the shaped inclined surface can be geotextile or geomembrane fabric or film. Further, the same material can be metallic panels, panels of molded plastic, panels comprised of a composite of reinforcement fiber and binding matrix resin, roofing shingles, roofing waterproofing paper, or conventional house waterproofing materials, The embodiments also provide for a method of flowing liquids and solids out of the system. Located at the bottom of the inclined surface which is also on the bottom of the volume, this method can be a perforated drainpipe or fabricated from materials similar to those described for the inclined panels. Once the method of flowing liquids and solids out of the system is placed, more suitable fill material of one or more types is added to the volume to establish a top surface.

The bottom drainpipe may further be attached to an adjacent vertical pipe extension that curves upward and reaches above the anticipated top surface height of the volume. The vertical pipe extension may be used for inspection of the drainpipe at the bottom of the volume, or for introducing high-pressure water for purposes of flushing solids through and out of the drainpipe.

BRIEF DESCRIPTION OF THE SEVERAL VIEWS OF THE DRAWING

So that the manner in which the above recited features, advantages and objects of all embodiments are attained and can be understood in detail, a more particular description of specific embodiments, briefly summarized above, may be had by reference to the embodiments thereof which are illustrated in the appended drawings.

FIG. 8 shows an embodiment placed over inclined angle rock piles and drainpipes placed between the piles. FIG. 8 also shows vertical pipes used for inspection and flushing of drainpipes.

FIG. 9 shows the space between the storage volume's end wall and the first rock pile filled with rock that forms the top surface of the volume.

FIG. 10 shows more spaces between rock piles filled with more rock to form a top surface.

DETAILED DESCRIPTION OF THE INVENTION

The need was recognized for an improved method of operation that would permit combining the best features of all existing systems yet overcome as many of their faults as possible. The ideal system would be as cost-effective as the lowest-cost alternative (usually a pond), would allow use of the surface (like most underground systems) but not require concrete pavement on top (like a rock bed system).

A prior-art rock bed storage system comes the closest to meeting all requirements, but the challenge of preventing the accumulation of sediment, sand and debris had to be overcome if rock bed storage was to be a candidate method. Also, a method to inspect the capacity of a rock bed system from the surface would need to be implemented. A verifiable solution to these two problems would be required to obtain approval by entities such as TxDOT. These embodiments make possible a low-cost underground rock bed storage system free of the cited problems by providing greatly improved capability for self-cleaning and allowing inspection and cleaning from the surface if ever needed.

While the foregoing is directed to the specific embodiments, other and further embodiments may be devised without departing from the basic scope thereof, and the scope thereof is determined by the claims which follow.

Description of Specific Embodiments

Figure 1:
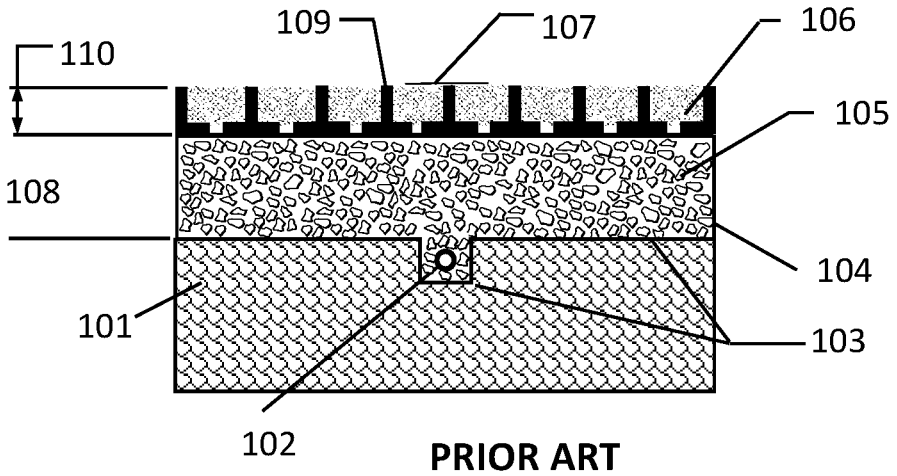
PRIOR ART FIGURE 1
FIG. 1 schematically illustrates a cross-section of the prior art underground stormwater containment system that includes a plastic paver element at the top surface and drainpipe at the bottom of the lined, flat-bottom rock bed storage volume.

FIG. 1 is a cross-section of the prior art, specifically the design for an underground stormwater detention system recommended by the manufacturer of a permeable plastic grid product called "TRUGRID®" shown installed near the top surface of the system. The grid component is the 'One Piece Water Permeable Paver' patented by Stiles. The interlocking plastic paver grids 109 are filled with smaller rock 106, ¾" clean washed aggregate or similar, to the full paver thickness 110, in this case 1.8 inches. Various manufacturers make panels to similar thickness dimensions and load-carrying capabilities.

These interlocking plastic grids 109 serve two purposes: 1) They stabilize the top layer of rock to create and maintain a smooth top surface 107 for vehicle traffic, and 2) The smaller rock 106 acts as a filter for debris and objects of a certain size or larger. Below the flat bottom of the detention/retention volume is Paving Subgrades 101, commonly sand that creates a smooth bearing surface for the bottom liner layer of Geotextile fabric 103. This layer is usually sealed at its seams to create a watertight membrane layer. Taking water away from the system to an outfall is a drainpipe 102, the manufacturer's recommended configuration being a Ø4" Schedule 40 perforated PVC drainpipe wrapped In Geotextile Fabric. Most of the storage volume is provided by the sub-base 105, generally 1" clean, washed angular stone that fills the volume for the storage depth 108, which provides 40% void space 104 for containment of stormwater. Additional storage volume is provided by the void space in the rock that fills the plastic paver grids to the height of the full paver thickness 110.

Figure 2:
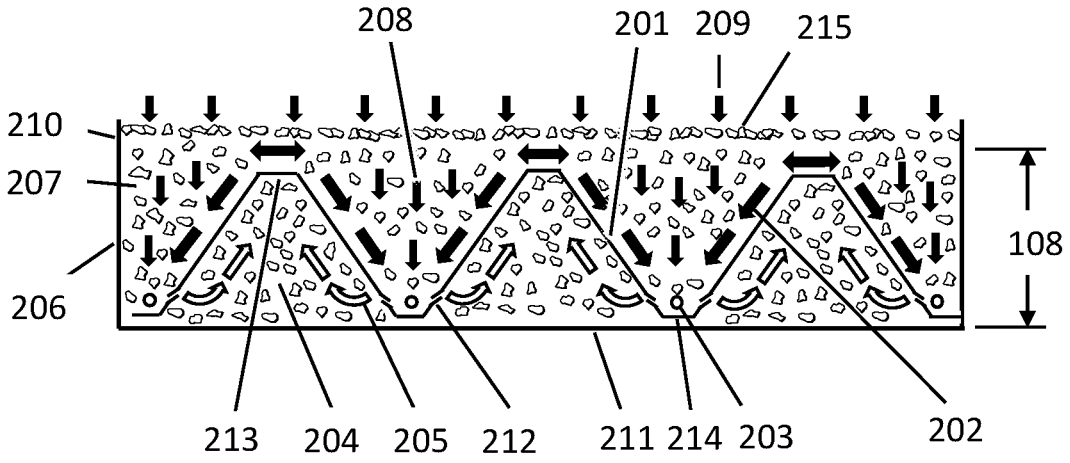
FIG. 2 is a cross-section of an embodiment as installed in a rock bed storage volume with arrows showing water and solids flow (dark filled arrows) and water without solids flow (outlined arrows).

FIG. 2 is a cross-section of one embodiment as installed in an underground volume of depth 108. Pieces of geomembrane fabric liner 206 are seamed together to create a water containment volume with sidewalls 210 and floor 211. While permeable paver grids 109 may be used to cover the top of the storage volume as in FIG. 1, they are not required for any of the embodiments to function, nor included in any claim.

Inclined panels 201 are laid over rock 204 which has been installed on the floor 211 and shaped to achieve inclined surfaces to support the panels 201. Panels 201, which, in this embodiment are one or more layers of geomembrane fabric, can be assembled using a mix of various materials and sizes, attached together or overlapped. They can be attached to side wall 210 or floor 211 or not.

Perforated drainpipes 203 lie at the bottoms of the troughs created between adjacent inclined surfaces. The drainpipes are sized according to expected flowrates, which will vary according to system depth 108, incline angle 301 and environmental parameters previously described used for the system design capacity. Drainpipes may be constructed and joined using any conventional materials and methods.

Rock 207 is installed above the panels 201. Rain 209 falling on the top surface of rock 215 will combine with previously deposited solids such as sand, soil, dirt, sediment, or organic matter. Arrows show the resultant water and solids (stormwater) flow 208 (represented by the dark filled arrows). This stormwater 208 flowing down through the rock bed contacts panels 201 and is deflected by them. The deflected stormwater 202 flows down the incline formed by panels 201 with increasing velocity due to the mass of stormwater steadily increasing as water travels further downward and rainfall of a large surface area is concentrated further together at the bottom. Increased velocity of solids translates to less solids left behind on the inclined surfaces. At the bottom of the trough 214 between adjacent panels, the total amount of water flowing into the pipes is equal to all the water that fell on the top surface area between the crests 213 of adjacent rows of rock piles. Once reaching the bottom of the trough between inclined panels, stormwater carries solids into the perforated drainpipes 203.

Water that has stagnated at the bottom of the trough 214 formed by adjacent inclined panels will tend to leave any solids it carried down at the lowest point near the drainpipe where it eventually flows into the drainpipe and out of the system. If there is more water flowing into the system than can run out through the drainpipes, the level of standing water at the bottom of the system will rise accordingly. The rising water without solids (represented by outlined arrows) 205 is free to flow upward into the volume of rock 204 under the inclined surfaces. For this embodiment, it enters these covered volumes through protected overlapping openings 212. Water with sediment flowing down to the trough bottom 214 over the openings 212 will not enter through them. Water travelling upward through openings in panels 201 leaves its solids on the bottom. This maintains the covered volume of rock 204 free from solids accumulation. Openings 212 can instead be slits or slots cut in panels after placement. These can be covered with adhesive tape to create a flap that is open at its bottom edge, or a separate overlapping piece mechanically attached to the panel 201 also open at its bottom edge. The openings can also simply be gaps left between adjacent or overlapping panels.

Figure 3A:
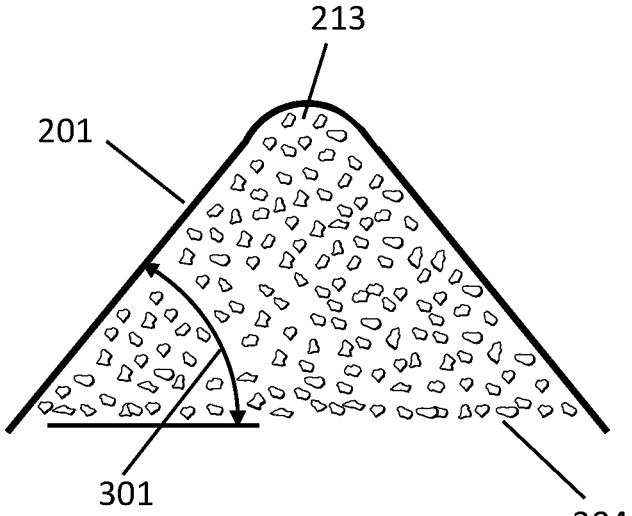
FIG. 3A is an end view of the inclined panel installed over the rock fill material piled at angle of repose.

FIG. 3A is an end view of the panel 201 installed over the rock 204. When rock is poured from above onto a pile in one spot, it creates a pile in the shape of a cone, with angled sides and roughly circular base. The angle of the cone above the horizontal is called the angle of repose for the rock, and it varies by type and shape of rock, but only slightly. Angles of repose are all roughly 45 degrees from horizontal. If the pour point of rock from above the pile translates at a constant velocity along a horizontal line, the resultant pile is a shape shown in FIGS. 3A (end view) and 3B (trimetric view). The angle of repose is still present but instead of circular piles, the piles are linear with a crest 213 parallel to the line of travel of the pouring device. While this embodiment shows rock 204 being used to fill the volume, creating an angle of repose 301, other embodiments can use a mix of many types of rock, crushed concrete pieces, or crushed asphalt pieces. Some or all objects filling the volume can be attached together, either rigidly or flexibly. Further, the resultant angle produced by the fill materials can vary widely and still function as intended.

Figure 3B:
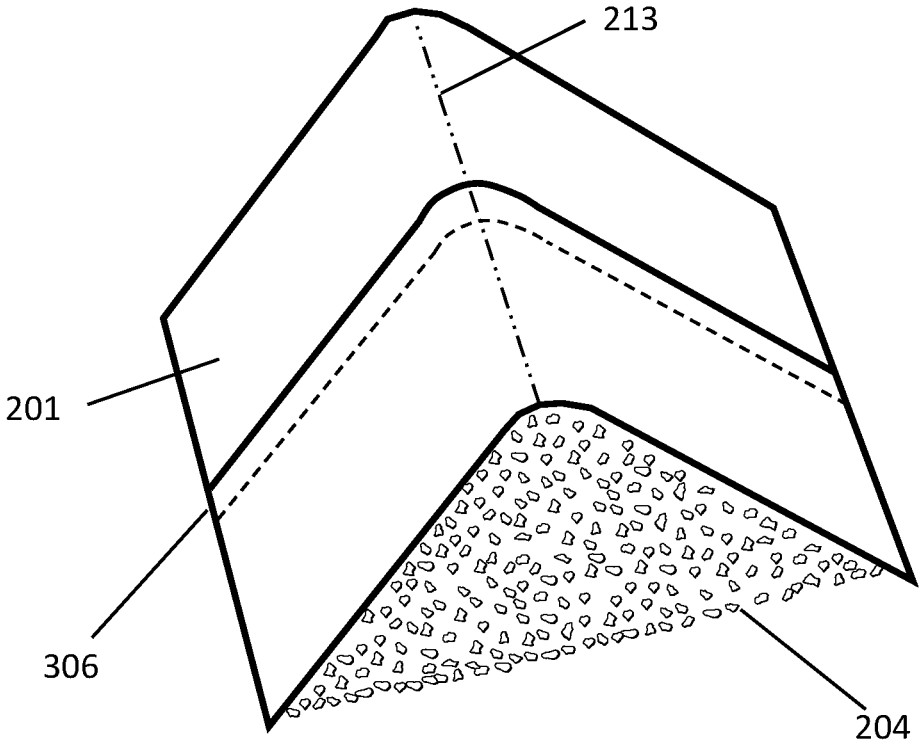
FIG. 3B is trimetric view of inclined panels placed over rock fill material that has been shaped at an inclined angle.

FIG. 3B is trimetric view of a panel placed 201 over rock that has been shaped at an inclined angle, which, in this embodiment is close to or at the angle of repose 301 for the rock used. Panels 201 can be single pieces, or multiple pieces and of of varying shapes and sizes. The pieces can be installed with an overlap 306, connected or neither. Panels may be of many different materials both rigid and flexible. Materials for panels should not be adversely affected by water over time in order for the system to maintain performance over long periods. This embodiment provides for panels 201 of geomembrane fabric or similar flexible fabric specially designed for use in underground applications. To install, it is easily handled manually with no special equipment, and can be seamed together by hand using hot air seam sealers. Alternatively, edges of adjacent panels can be overlapped as they come off a roll or unfolded and positioned by hand. A sufficient overlap distance will prevent stormwater flowing downward from travelling sideways and entering the volume 204. Panels can also be handled and placed by conventional or specialized machinery if it is of benefit to the installer.

Figure 3C:
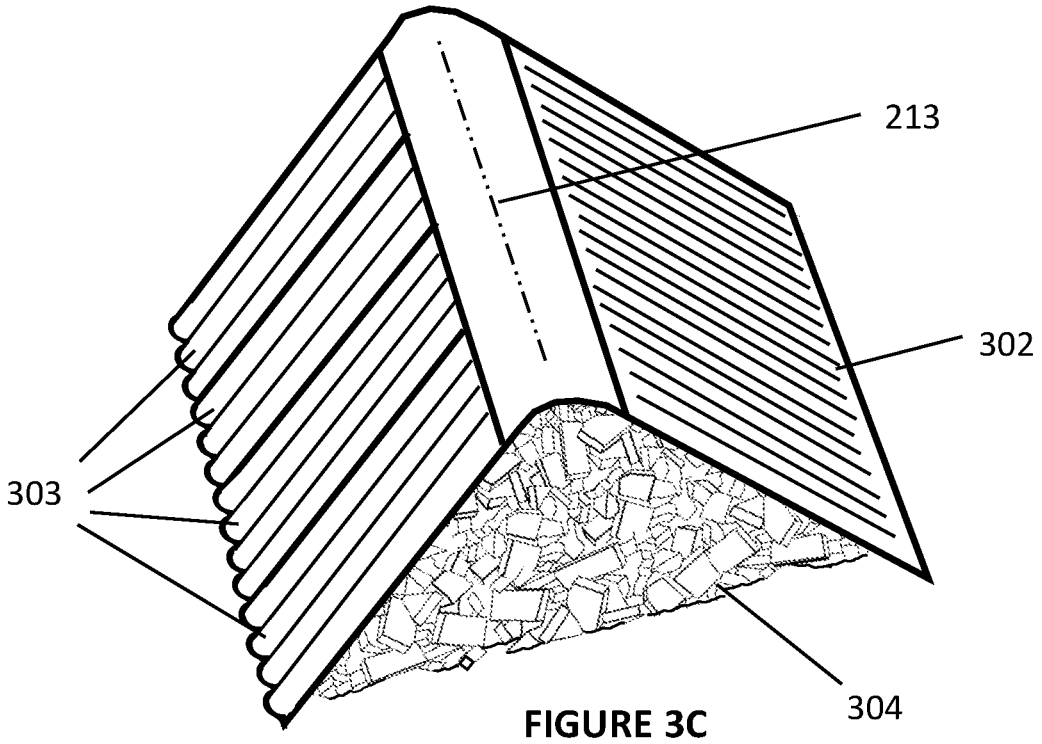
FIG. 3C is a trimetric view of inclined panels that are metallic, plastic or composite installed over bricks used a filler material.

FIG. 3C is trimetric view of alternate embodiments. Inclined panels can alternatively be solid plastic, molded fiberglass-epoxy composite panels 302, or metallic pieces 303. Panels can be recycled or repurposed, or an assemblage of two or more of these materials. Fill material in this embodiment is bricks and brick pieces 304, new or recycled, broken or whole, forming a crest 213.

Figure 3D:
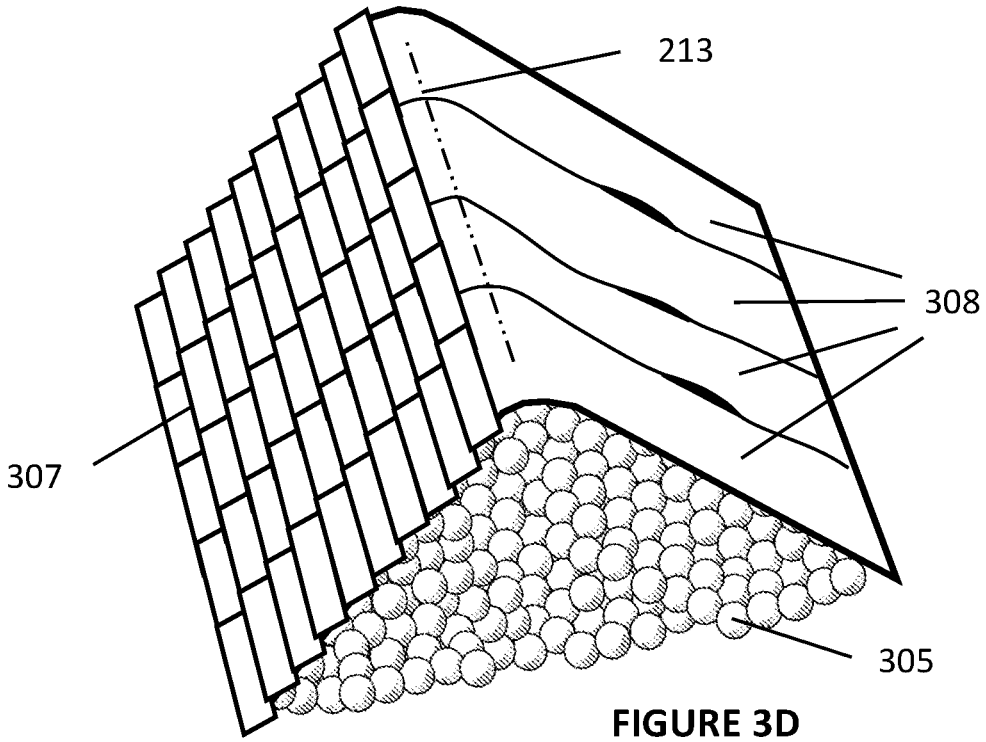
FIG. 3D is a trimetric view of inclined panels installed over spheres or other objects that can be hollow or solid.

FIG. 3D is trimetric view of an embodiment that utilizes inclined panels alternately consisting of roofing shingles 307 or roofing waterproofing paper or house waterproofing material 308 installed over man-made objects 305 that offer functionality as a filler material. Shingles 307 may be separate or attached to one another using conventional methods and materials (not shown). Pieces of paper or material 308 may be overlapped or joined together using conventional methods and materials (not shown). Objects 305 may be hollow or solid. Objects 305 can be poured concrete, molded plastic, molded fiberglass-epoxy composite, or metallic. They can be attached to one another or detached.

Figure 4:
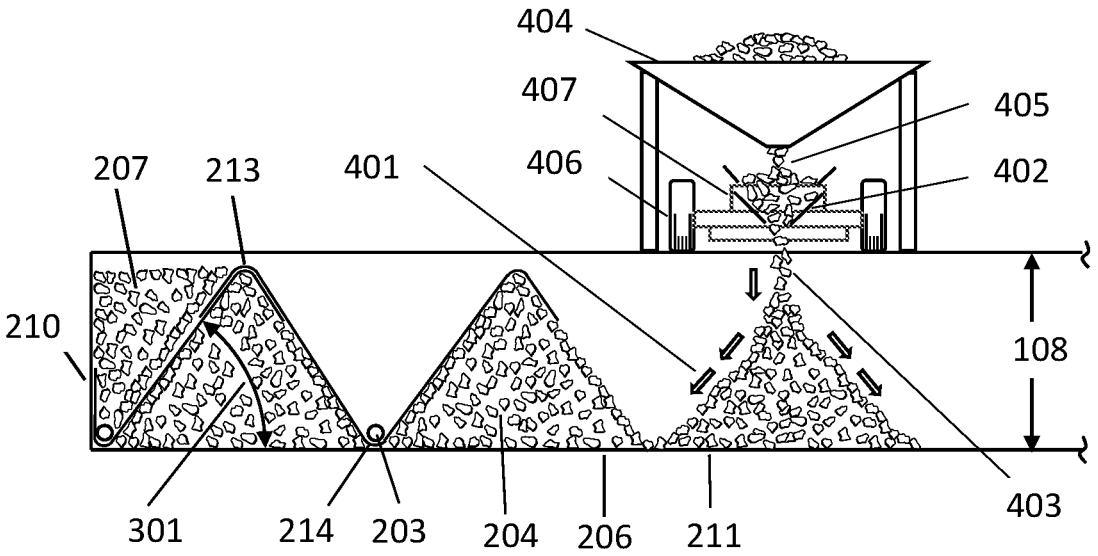
FIG. 4 is an elevation view of an underground rock bed storage volume with piles of rock having sides at inclined angles and showing the progressive steps of the process that covers them with panels. It also shows an end view of a travelling conveyor and hopper system that delivers rock from the surface adjacent to the rock bed to each pile being formed.

FIG. 4 is a cross-section view of an underground rock bed storage volume with piles of rock having inclined sides at angles 301. It shows the progressive steps of the process that 1) forms the pile (rightmost), 2) covers it with panels (pile in the middle) and 3) fills the rest of the system to the top (between the leftmost pile and the sidewall 210). It also shows an end view of a conventional travelling conveyor 406 and hopper system 404 that operates adjacent to and aligned with each pile being formed. Direction arrows show the movement of rock deposited into the hopper 404. Rock 405 flows out the bottom of the hopper 404 and onto the conveyor belt 407 of the moving conveyor apparatus 406. After being centralized into a smaller zone by the conveyor's side panels 402, Rock 403 falls off the end of the belt to the location of the rockpile being formed. Dropped rock flows in the direction 401 down the sides of the pile as it gradually forms angle 301.

Figure 5:
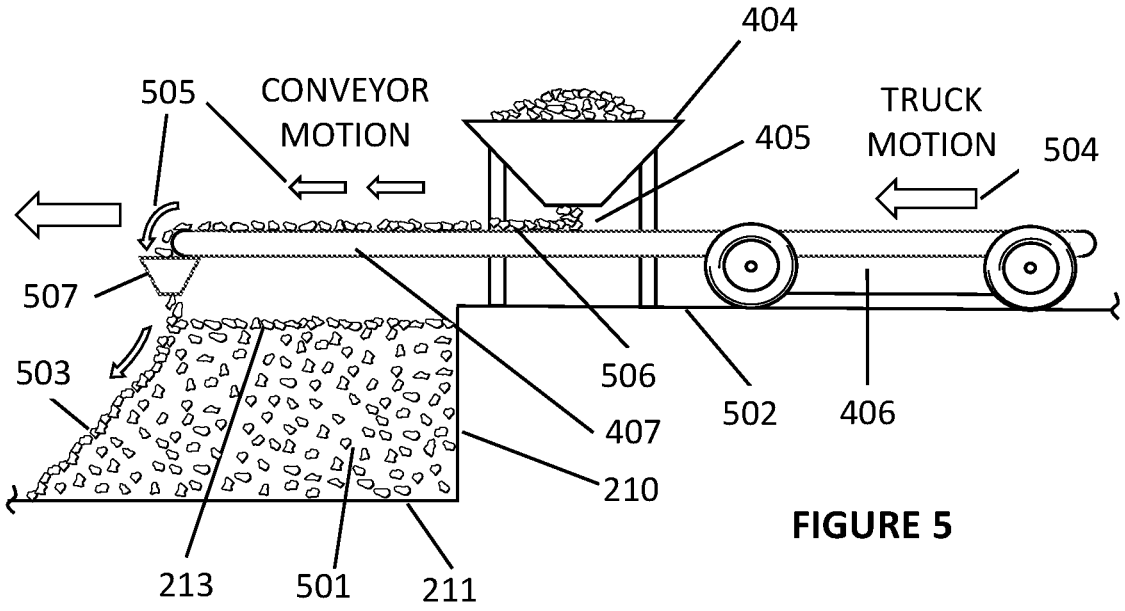
FIG. 5 is a view orthogonal to that of FIG. 4 and showing of the operation and equipment shown of FIG. 4.

FIG. 5 is a view orthogonal to that of FIG. 4 and shows operation of the equipment shown in FIG. 4. Rock 405 is meted out from the hopper 404 onto the belt 407 of the conventional moving conveyor apparatus 406. Large arrows 504 show the direction of the whole conveyor device as the belt delivers rock 506 off the end. Rock 506 is carried to the end of the belt 407 where it falls into a funnel 507 and is concentrated into a small area as it flows through. Falling rock 403 is deposited onto the pile being formed. The rock 503 falls in a manner that forms inclined surfaces at the angle of repose for the type of rock being used and with crest 213 of approximately even height. The conveyor 406 travels at constant speed on the surface 502 adjacent to the rock bed volume. As the process progresses, the conveyor 406 proceeds in the direction of the arrows 504 and creates a pile of rock with even surfaces 502 and approximately linear crest 213.

Figure 6:
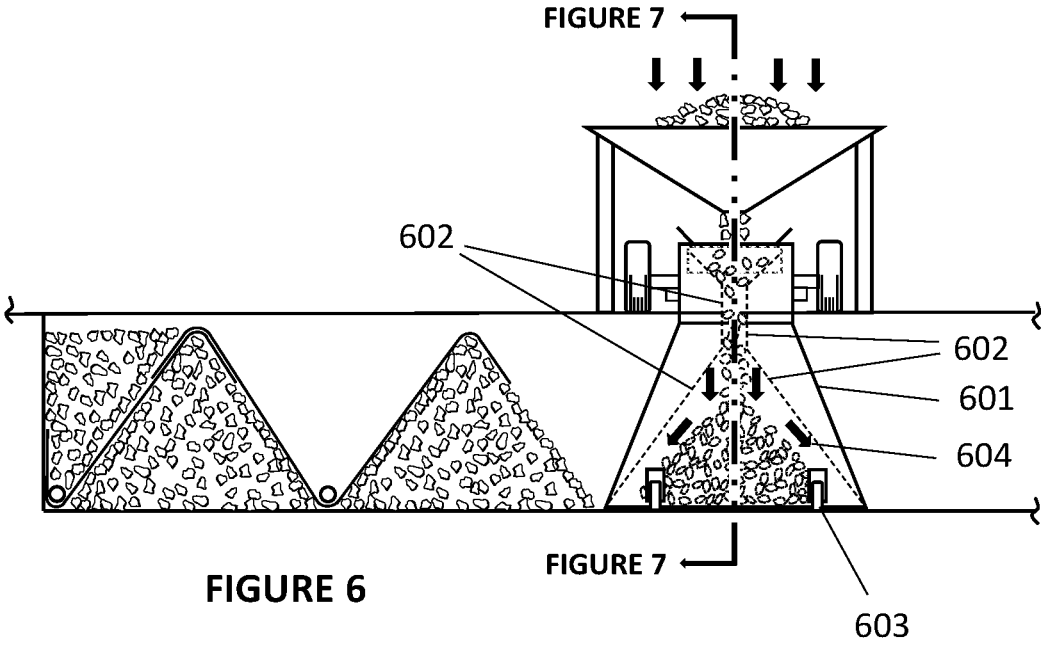
FIG. 6 is an elevation view similar in content and with the same point of view as FIG. 4, but it shows a conveyor system with added assembly consisting of an end deflection panel, side panels and guide wheels installed at the forward end of the conveyor belt. The assembly receives and directs filler material to the end of the pile being formed at a prescribed angle.

FIG. 6 is a view similar in content and with the same point of view as FIG. 4, but it shows an alternate configuration for the conveyor system with added end deflection panel 601, side forms 602 and guide wheels 603. The end deflection panel 601 and side forms 602 are attached to the end of the conveyor 501 and are supported above the floor of the storage volume 211 by wheels 603. These assembled components at the end of the conveyor belt receive and direct rock 506 and direct it to flow to the end of the pile 604 being formed. With the side forms 602, they more directly and consistently form the inclined surfaces from the rock as they travel along with the conveyor. The end deflection panel 601 and side forms 602 are a mechanical method to assist in forming the angle of repose that offers more control and speed to the process while reducing the criticality of controlling the conveyor velocity to get an even surface 502.

Figure 7:
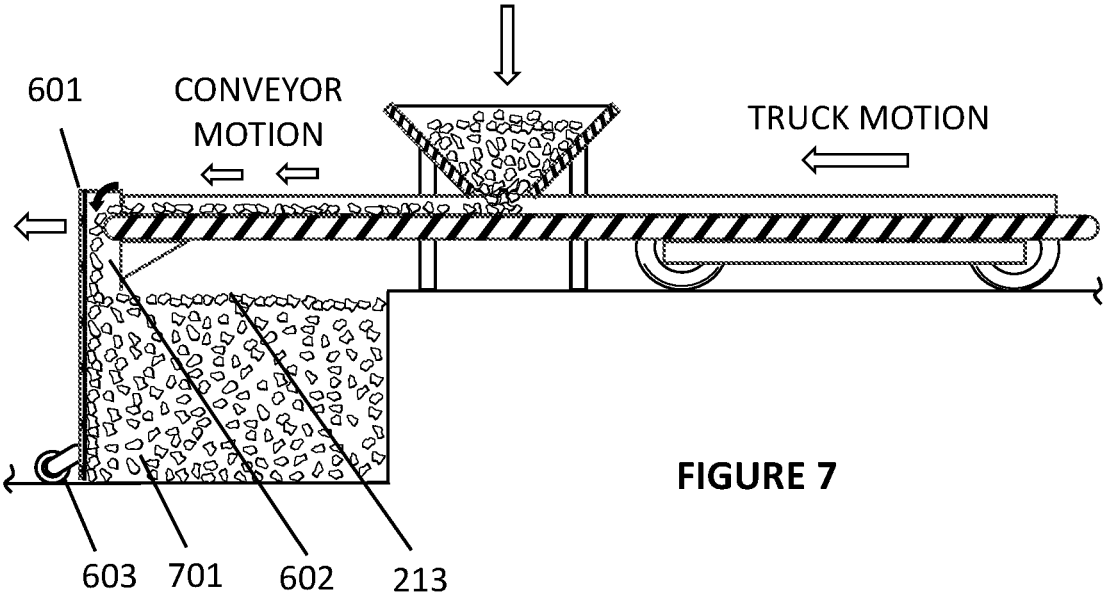
FIG. 7 is an orthogonal section of FIG. 6 and showing of the operation and equipment shown of FIG. 6.

FIG. 7 is an orthogonal section of FIG. 6. This view shows how rock from the conveyor falls onto the rock being restrained and formed by the end deflection panel 601 and side forms 602. This rock will flow down as far as it can to establish a stable, packed volume 701 at the angle which the side forms 602 attach to the end panel.

The equipment and arrangements shown are, in the opinion of the inventor, the most cost-efficient methods of producing the desired configuration for outfitting a storage volume. Most components are conventional units commercially available from several manufacturers, and the ones that are not can be easily fabricated. While these figures show what is understood to be two of the most direct and effective methods of depositing fill materials into the volume, this process can also be accomplished by any suitable conventional method of conveying and placing the materials being used, including placing and shaping fill material by hand using implements like shovels, or rock piled on tarps and dragged to their position by hand. Various standard earthmoving machines can also be used to accomplish the same task. Piles of fill do not have to be formed into lines—In other embodiments, they may remain as-deposited in conical shapes, or curved paths of any manner feasible and covered accordingly.

Figure 8:
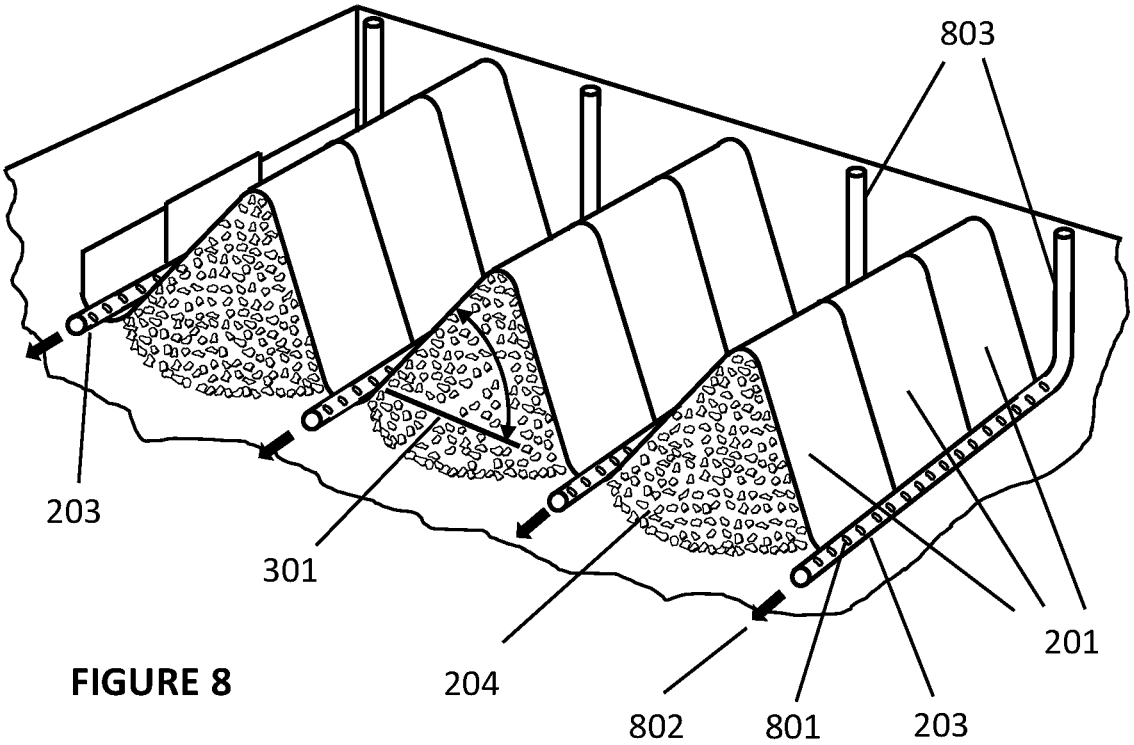
FIGS. 8 through 10 are isometric views of part of an underground rock bed storage volume. The figures show the progression of construction of the volume.
Figure 9:
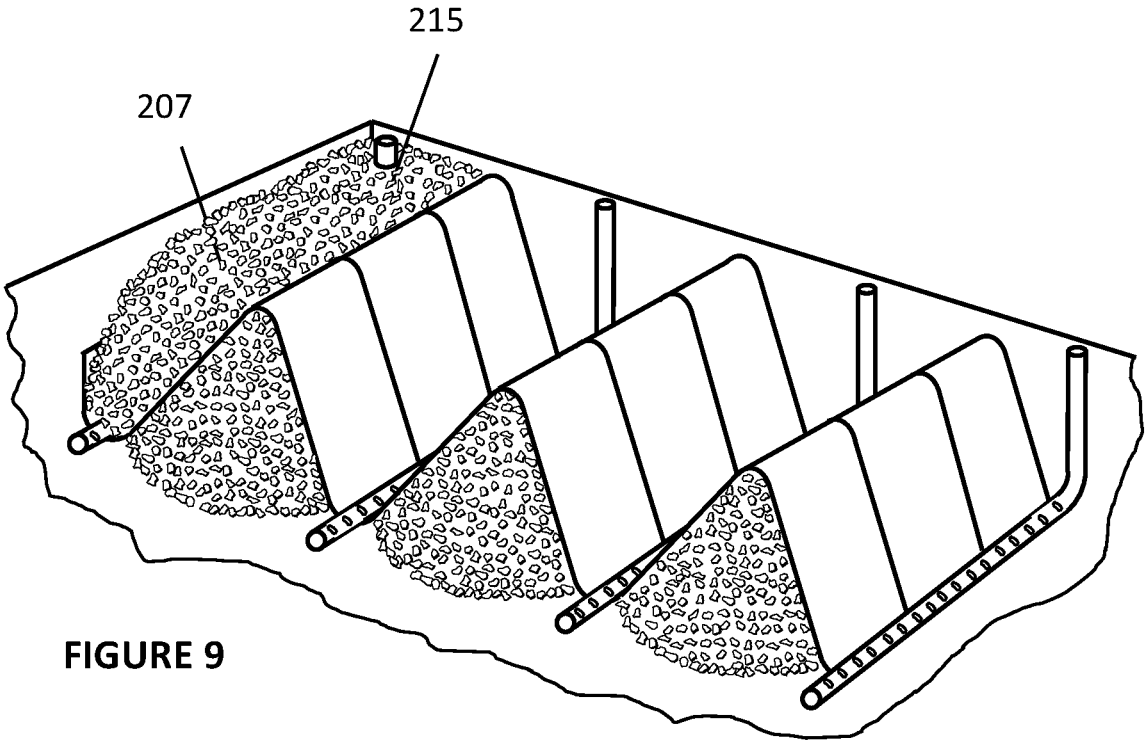
Figure 10:
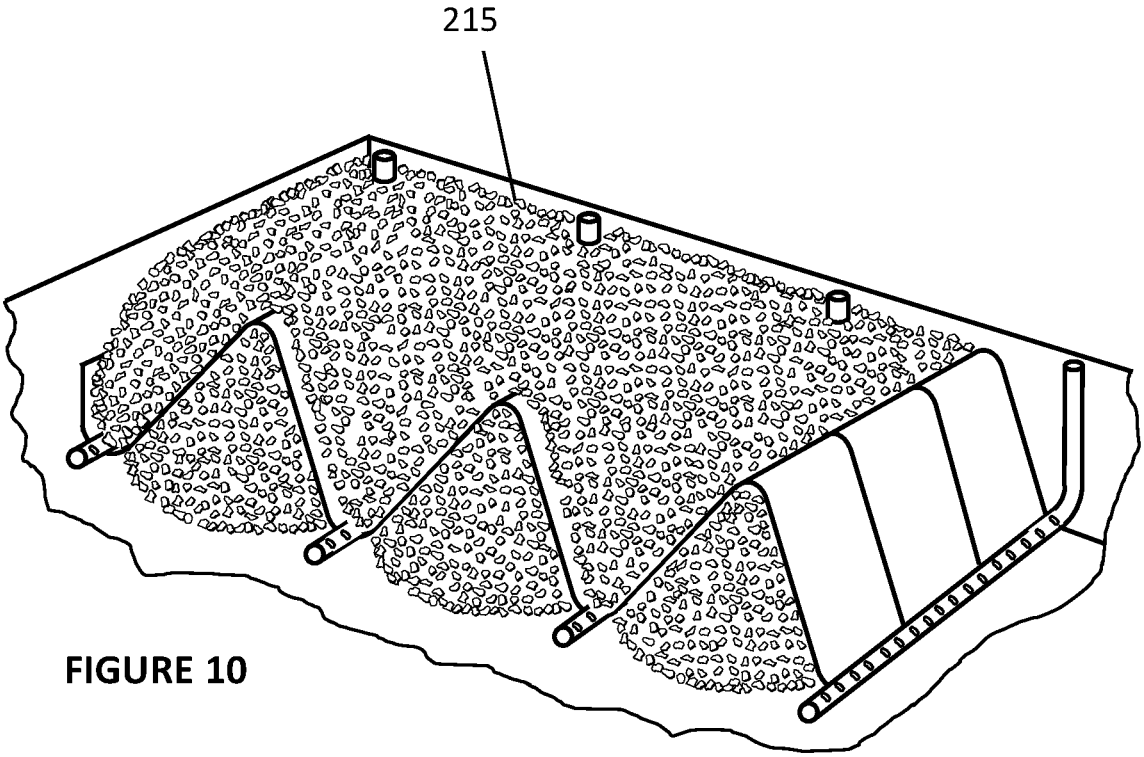

FIGS. 8 through 10 are isometric views of part of an underground rock bed storage volume. The figures show the progression of construction of the volume. FIG. 8 shows the embodiment placed over inclined angle rock piles and drainpipes 203 placed between the piles. Stormwater 208 that has carried solids with it down the inclined panels 201 flows into the perforations 801 in the drainpipes 203 and the resultant flow 802 takes it out of the storage system to an outfall. This view also shows how inclined panels 201 can be placed on the rock piles 204 with their edges overlapped. Vertical pipes with curved connectors 803 are connected to drainpipes 203 and extend to above the design level 901. These vertical pipes with curved connectors 803 provide access for inspecting drainpipes 203 using fiberoptic camera and also provide access to insert high-pressure water into drainpipes 203 for purposes of flushing drainpipes 203 if ever needed.

FIG. 9 shows the space between the storage volume's wall 210 and the first rock pile filled with rock that forms the top surface 215 of the volume. Once the drainpipes 203 have been placed and joined to successive pipes downstream to route the water out of the system, fill rock 207 is placed in the areas on top of the panels 201 to the design level 901 for the system. This level will cover the crests 213 and will commonly be flush with ground adjacent to storage volume edge 503.

FIG. 10 shows more spaces between rock piles filled with more rock 207 to form a top surface 215 suitable for vehicle or pedestrian travel, parking, or storage. It may be seen that other embodiments will vary the shapes and dimensions of shaped piles. Pile heights and spacing between piles are not critical and can be adjusted to suit an application. The sizes and depths of resultant systems are not limited by the method.

Figure 11A:
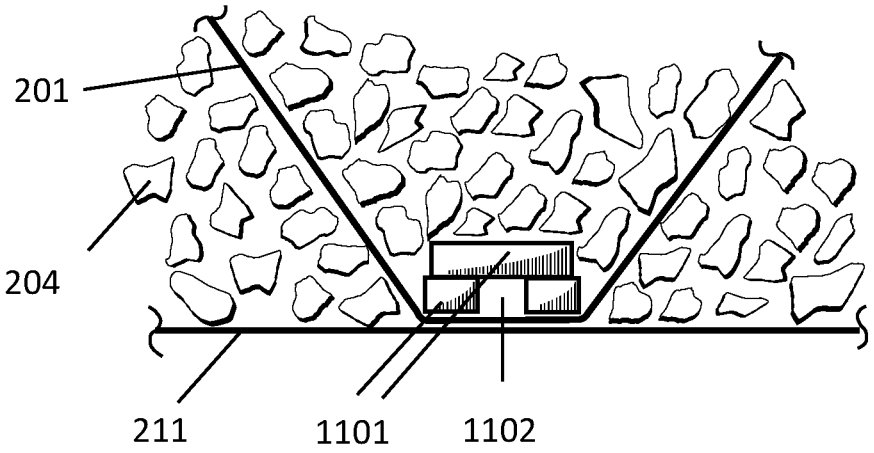
FIG. 11A is an elevation view showing bricks used to create the method of flowing solids and water out of the volume.

FIG. 11A is an elevation view showing bricks used to create the method of flowing solids and water out of the volume. Conventional bricks 1101 may be arranged along the trough 214 between adjacent inclined panels as shown to create a protected volume 1102, through which solids and water can flow. As the trough may be curved or straight, the bricks can be arranged to fit the path it takes between adjacent piles.

Figure 11B:
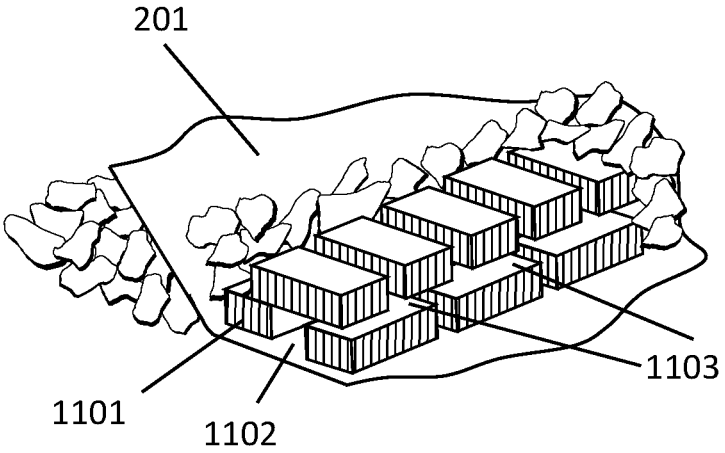
FIG. 11B is an isometric view of how the bricks shown in FIG. 11A are arranged.

FIG. 11B is an isometric view of how the bricks shown in FIG. 11A are arranged. Spaces 1103 between bricks at the bottom allow solids and water to flow into the protected volume 1102.

Figure 12A:
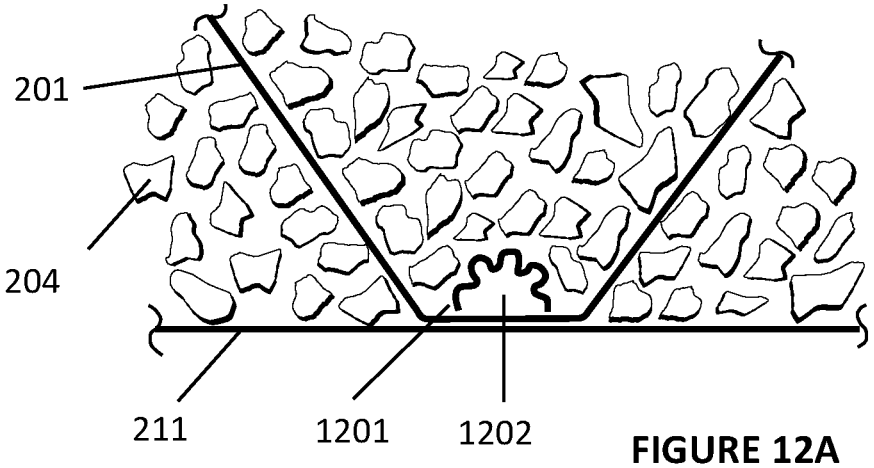
FIG. 12A is an elevation view showing a corrugated metallic panel creating the path for flowing solids and water out of the volume.

FIG. 12A is an elevation view showing a corrugated metallic panel 1201 being used to create the method of flowing solids and water out of the volume. The panel's curved shape imparts the strength it will need to withstand the weight of rocks piled on it.

Figure 12B:
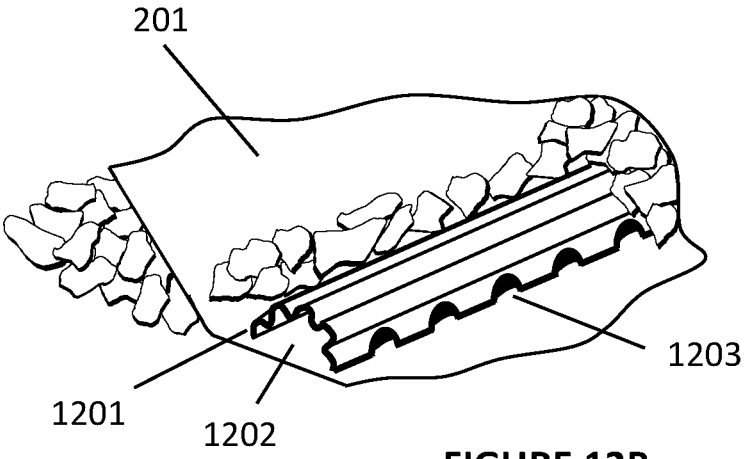
FIG. 12B is an isometric view of how the panel shown in FIG. 11A is modified with openings to allow sediment and water to flow into the protected volume it creates.

FIG. 12B is an isometric view of how the panel shown in FIG. 12A is modified with openings 1203 to allow sediment and water to flow into its protected volume 1202.

List of Reference Numerals

| No | Description |
|---|---|
| 101 | Paving Subgrades (Sand) |
| 102 | Ø4" Schedule 40 Perforated Plastic Drainpipe Wrapped In Geotextile or Geomembrane Fabric |
| 103 | Geotextile or Geomembrane Fabric |
| 104 | Rock's 40% Void Space For Detention |
| 105 | Rock Sub-Base: 1" Clean, Washed Angular Stone |
| 106 | Rock Fill Material for Grid: 1.8" Depth Of ¾" Clean Washed Aggregate |
| 107 | Top Surface of Plastic Paver Grid Pieces |
| 108 | Rock Bed Storage Depth Dimension |
| 109 | Plastic Paver Grid Device |
| 110 | Thickness of Plastic Paver Grid Device (Approximately Two Inches) |
| 201 | Inclined Panel |
| 202 | Stormwater Collected by, and Redirected by Inclined Panel |
| 203 | Perforated Drainpipe Between Inclined Panels |
| 204 | Rock Installed under Inclined Panels |
| 205 | Water Flowing Into Covered Volume Through Opening in Adjacent Panels. |
| 206 | Geomembrane Fabric Liner for storage volume |
| 207 | Rock Installed Over Inclined Panels |
| 208 | Stormwater Flowing Through Rock Bed |
| 209 | Rain Falling on Top Surface |
| 210 | Wall of Storage Volume |
| 211 | Floor of Storage Volume |
| 212 | Protected Overlapping Opening in Incline Panel Allowing Water Flow upward into covered volume |
| 213 | Crest of Rock or Other Fill Material Installed under Inclined Panels |
| 214 | Trough between Inclined Panels under Drainpipe |
| 215 | Top Surface of Storage Volume |
| 301 | Incline Angle to Horizontal/Angle of Repose |
| 302 | Plastic or Composite Panel |
| 303 | Metal Panels |
| 304 | Bricks, whole or broken |
| 305 | Hollow or solid objects |
| 306 | Overlap of One Panel 201 over an adjacent Panel 201 |
| 307 | Roofing Shingles |
| 308 | Roofing Waterproofing Paper or House Waterproofing Material |
| 401 | Flow of Rock Downward to Form Angled Incline Pile |
| 402 | Conveyor Side Panels Directing Rock into A Small Area of Deposit onto Pile |
| 403 | Rock Falling from Conveyor onto Pile |
| 404 | Overhead Hopper Feeding Mobile Conveyor |
| 405 | Rock Falling from Hopper onto Conveyor |
| 406 | Mobile Conveyor Truck Travelling at Constant Speed Toward Rock Bed Volume |
| 407 | Conveyor with Belt Surface |

-continued

List of Reference Numerals

| No | Description |
|---|---|
| 501 | Rock Free Flowing to Achieve Angle of Repose and Form Inclined Planes on Either Side of Crest 213 |
| 502 | Ground Adjacent to Storage Volume Edge |
| 503 | Rock Travelling Down Pile to Form Incline Angle 301, Which Is Angle of Repose for That Type of Rock (approx. 45°) |
| 504 | Direction of Conveyor Truck Travel |
| 505 | Direction of Rock Travelling on Conveyor |
| 506 | Rock Travelling on Conveyor |
| 507 | Funnel Directing Rock into A Small Area of Deposit onto Pile |
| 601 | End Deflection Panel Creating Barrier for Rock Formation and Enhancing Rock Flow Toward Side Forms 602 |
| 602 | Side Forms Creating Barrier for Rock Flow at Angle of Repose for More Consistent Surface Formation |
| 603 | Guide Wheels at Bottom of End Panel Prevent it from Digging into bottom of Storage Volume |
| 604 | Flow Direction Of Rock Falling Down Between Side Panels 602 |
| 701 | Rock formed at Angle of Repose by Side Panels Ready for Covering |
| 801 | Perforations in Top Halves of Drainpipes |
| 802 | Direction of Flow of Water and Solids toward Outfall (Exit) for the System |
| 803 | Vertical pipe sections with curved connectors feed into Drainpipe 203 for inspection and flushing of Drainpipe 203 |
| 1101 | Bricks Arranged to Create Protected Space for Flow of Water and Solids |
| 1102 | Protected Space Created by Bricks |
| 1103 | Spaces Between Bricks |
| 1201 | Corrugated Panel |
| 1202 | Protected Space Created by Corrugated Panel |
| 1203 | Openings in Corrugated Panel |

Operation of Specific Embodiments

The embodiments all provide a method that requires little or no maintenance and functions with no intervention or monitoring. Solid matter will collect on the surface of the system on a continuous basis. The larger solid pieces that are unable to fit between rocks will remain on the top of the surface. These pieces either remain and get vacuumed up during maintenance operations or decompose further and then flow downward. When storms occur, the runoff and direct rainfall will enter the system and wash the smaller solids down into the volume with it. Solids movement occurs when stormwater is flowing through the system. Once the water has drained out, the system is static and accruing more solids on the top surface until the next storm event.

Stormwater 208 including the solid particles flows down through the rock bed, contacts inclined panels 201 and travels down the panels toward the trough 214 between them. Because the surface is on an incline and relatively smooth, water and solids flow down the incline at an increased velocity. The collected volume continuously increases as more volume flows downward and joins the flow moving down the incline.

The deflected stormwater 202 flows down the inclined panels 201 increasing its velocity as it progresses due to the mass of stormwater steadily increasing as water travels further downward and collects more vertical flow. An increased flow rate carries sediment more effectively because it has more kinetic energy behind it. While some of the solids will be permanently trapped by the rocks where flow paths are blocked and become clogged, this amount is relatively small and finite, and water flow carries remaining and subsequent solids through the rocks to the bottom of the inclined surfaces and into drainpipes.

Water with sediment flows over the opening 212 and down to the trough bottom 214. Water that has stagnated at the bottom will tend to leave any solids it carried down at the lowest point near the drainpipe 203 where it eventually flows into the drainpipe 203 and out of the system when flow increases again. At the bottom of the trough 214 the total amount of water flowing into the pipes is equal to all the water that fell on the top surface area between the crests 213 of adjacent rows of rock piles. The embodiments show the drainpipes 203 being perforated on their upper surfaces only. This leaves the bottom portion of the pipes' interior surfaces smooth, which will better carry water and solids across the volume and to an outfall. Alternatively, the drainpipes 203 can have perforations (holes) around all or part of the surface, when the resultant changes in their flow performance are deemed acceptable. Instead of drainpipes 203, some embodiments show bricks 1101 and corrugated metal panel 1201 providing the method for conveying solids and water through the system and out.

If water levels at the bottom of the volume are too high to allow immediate entry into drainpipes 203, water 205 can change direction and enter the covered volumes 204 under the inclined panels 201 through openings 212. Other embodiments provide this access by simply leaving seams or overlaps between adjacent panels partially or completely detached, or edges of panels and adjacent side walls partially or completely detached. Since the flow of water 205 is in an upward direction at low velocity, solids being carried by it will be settled out at the bottom of the trough, and little or no solids will flow into the covered volumes 204, which will keep volumes 204 free from solids buildup. At least most of this water will eventually flow back out through the openings 212 and into the drainpipes 203 to exit the system.

The standard maintenance of this system is vacuum cleaning of the top surface 215. This may be combined with sweeping and or grading of the rock at the top surface 215. If there are plastic paver grids 109 installed, they are not disturbed, but may require replenishing of the smaller rock 106 to restore their top surfaces 107.

Vertical pipes 803, if added to the system, are used to inspect their adjacent connected drainpipes 203 using conventional inspection methods such as a fiberoptic cable and a remote inspection camera. It is not anticipated there will be buildup, but if there is, this method allows the system owner to find and remediate it. If a drainpipe 203 is found to be clogged for some reason, the vertical pipe 803 attached to it allows access for insertion of a common sewer jetter flushing device to clear it.

Conclusion, Ramifications, and Scope

Prior art underground rock bed stormwater collection systems would be utilized more if they didn't suffer from the problems cited. Their greatest problems are ingesting sediment without effectively removing it, and not providing practical methods for inspection and removing solids or sediment. This will eventually lead to capacity reduction and reduced system function. Because regulating authorities expect stormwater collection systems to function indefinitely, most insist they be designed to allow maintenance, and that maintenance keeps them in a suitable state of function. These embodiments provide a novel method that overcomes those shortfalls. This method has been tested and proven with full-scale test apparatus under controlled test conditions.

The embodiments provided will either reduce or eliminate the accumulation of sediment, sand, and solid debris from collecting within a storage system filled with rocks or similar materials. They accomplish this by including inclined surfaces inside of a volume while allowing it to retain a flat bottom. A flat bottom is beneficial to have in designs of stormwater collection systems. This method allows the whole flat-bottomed volume to be used to retain/detain stormwater, but water and sediment entering the system runs down inclined surfaces that increase their velocities. The faster-flowing water is able to better wash out sand and sediment from in between rocks that make up the volume.

These embodiments solve the larger problem of high underground storage system costs by solving the smaller problem of making a lower-cost method work properly. While it uses no new materials or structures, it shows how to create an underground storage volume that is self-cleaning and maintainable from above ground. It eliminates the need for concrete, expensive underground volumetric structures, man-rated access, underground filter systems (and cleaning of same), surface pavement and storm sewers to collect and direct water into the underground systems.

If property owners are required to increase their stormwater retention capacities, they would undoubtedly look at implementing this method, as it is retrofittable almost anywhere there is a parking lot. The existing area can be converted to a combination underground rock bed storage volume with parking lot on the surface.

Methods to re-use or recycle building and construction materials will always be sought. One or more embodiments described here allows for materials originally used for other intents and purposes to be used or re-used to construct the inclined panels, fill material and drainpipes. If low-cost sources of these are available to the system builder, the total cost of the completed system will be reduced considerably.

What is claimed is:

1. A method of creating and using a stormwater containment system to enhance the flow of solids and liquids through a volume in the ground, comprising:

a. depositing a first material into the volume and shaping said first material to form a plurality of inclined surfaces within the volume and to also form at least one trough between adjacent inclined surfaces, the first material being discrete pieces creating voids within the volume;

b. covering each inclined surface with one or more layers of sheet material;

c. placing at least one means of flowing liquid and solids out of the system within the at least one trough;

d. depositing a second material on top of the layers and the means of flowing to substantially fill the volume, the second material being discrete pieces creating voids within the volume; and e. receiving liquids and solids into the system and using the means of flowing to flow the liquids and solids through and out of the volume.

2. The method of claim 1 wherein said first and second materials are solid, porous, or hollow.

3. The method of claim 1 wherein said first and second materials are rock, stone, concrete, asphalt, brick, hollow vessels, or a mixture of these.

4. The method of claim 1 wherein the inclined surface approximates the angle of repose of the first material.

5. The method of claim 1 wherein all or part of the sheet material is geotextile or geomembrane fabric or film.

6. The method of claim 1 wherein all or part of the sheet material is metallic, molded plastic, a composite of reinforcement fiber and binding matrix resin, roof or house waterproofing material, or roofing shingles.

7. The method of claim 1 wherein said means of flowing liquids and solids out of the system is a volume created to accept ingressing liquids and solids and allow them to flow to another location.

8. The method of claim 1 wherein said means of flowing liquids and solids out of the system is a perforated drainpipe, stacked bricks, or corrugated panel.

9. A method of creating and using a stormwater containment system with enhanced flow of solids and liquids through a volume, comprising:

a. depositing a first material into the volume and shaping said first material to form a plurality of inclined surfaces within the volume and to also form at least one trough between adjacent inclined surfaces, the first material being discrete pieces creating voids within the volume;

b. covering each inclined surface with one or more layers of sheet material;

c. creating or placing at least one means of flowing liquid and solids out of the system within the at least one trough;

d. depositing a second material on top of the layers and the means of flowing to substantially fill the volume, the second material being discrete pieces creating voids within the volume; and e. receiving liquids and solids into the system and using the means of flowing to flow the liquids and solids through and out of the volume.

10. The method of claim 9 wherein said first and second materials are solid, porous, or hollow.

11. The method of claim 9 wherein said first and second materials are rock, stone, concrete, asphalt, brick, hollow vessels, or a mixture of these.

12. The method of claim 9 wherein the inclined surface approximates the angle of repose of the first material.

13. The method of claim 9 wherein all or part of the sheet material is geotextile or geomembrane fabric or film.

14. The method of claim 9 wherein all or part of the sheet material is metallic, molded plastic, a composite of reinforcement fiber and binding matrix resin, roof or house waterproofing material, or roofing shingles.

15. The method of claim 9 wherein said means of flowing liquids and solids out of the system is a volume created to accept ingressing liquids and solids and allow them to flow to another location.

16. The method of claim 9 wherein said means of flowing liquids and solids out of the system is a perforated drainpipe, stacked bricks, or corrugated panel.

17. A method of creating and using a stormwater containment system with enhanced flow of solids and liquids through a volume in the ground, comprising:

a. depositing a first material into the volume and shaping said first material to form at least one inclined surface within the volume and to also form at least one trough between adjacent inclined surfaces, the first material being discrete pieces creating voids within the volume;

b. covering each inclined surface with one or more layers of sheet material;

c. creating or placing at least one means of flowing liquid and solids out of the system within the at least one trough;

d. depositing a second material on top of the layers and the means of flowing to substantially fill the volume, the second material being discrete pieces creating voids within the volume; and e. receiving liquids and solids into the system and using the means of flowing to flow the liquids and solids through and out of the volume.

18. The method of claim 17 wherein said first and second materials are solid, porous, or hollow.

19. The method of claim 17 wherein said first and second materials are rock, stone, concrete, asphalt, brick, hollow vessels, or a mixture of these.

20. The method of claim 17 wherein the inclined surface approximates the angle of repose of the first material.

21. The method of claim 17 wherein all or part of the sheet material is geotextile or geomembrane fabric or film.

22. The method of claim 17 wherein all or part of the sheet material is metallic, molded plastic, a composite of reinforcement fiber and binding matrix resin, roof or house waterproofing material, or roofing shingles.

23. The method of claim 17 wherein said means of flowing liquids and solids out of the system is a volume created to accept ingressing liquids and solids and allow them to flow to another location.

24. The method of claim 17 wherein said means of flowing liquids and solids out of the system is a perforated drainpipe, stacked bricks, or corrugated panel.

25. A method of creating and using a stormwater containment system with enhanced flow of solids and liquids through a volume in the ground, comprising:

a. depositing a first material into the volume and shaping said first material to form a plurality of inclined surfaces within the volume and to also form at least one trough between adjacent inclined surfaces or inclined surface and volume boundary, the first material being discrete pieces creating voids within the volume;

b. covering each inclined surface with one or more layers of sheet material;

c. creating or placing at least one means of flowing liquid and solids out of the system within the at least one trough;

d. depositing a second material on top of the layers and the means of flowing to substantially fill the volume, the second material being discrete pieces creating voids within the volume; and e. receiving liquids and solids into the system and using the means of flowing to flow the liquids and solids through and out of the volume.

26. The method of claim 25 wherein said first and second materials are solid, porous, or hollow.

27. The method of claim 25 wherein said first and second materials are rock, stone, concrete, asphalt, brick, hollow vessels, or a mixture of these.

28. The method of claim 25 wherein the inclined surface approximates the angle of repose of the first material.

29. The method of claim 25 wherein all or part of the sheet material is geotextile or geomembrane fabric or film.

30. The method of claim 25 wherein all or part of the sheet material is metallic, molded plastic, a composite of reinforcement fiber and binding matrix resin, roof or house waterproofing material, or roofing shingles.

31. The method of claim 25 wherein said means of flowing liquids and solids out of the system is a volume created to accept ingressing liquids and solids and allow them to flow to another location.

32. The method of claim 25 wherein said means of flowing liquids and solids out of the system is a perforated drainpipe, stacked bricks, or corrugated panel.

33. A method of creating and using a stormwater containment system with enhanced flow of solids and liquids through a volume, comprising:

a. depositing a first material into the volume and shaping said first material to form at least one inclined surface within the volume and to also form at least one trough between adjacent inclined surfaces, the first material being discrete pieces creating voids within the volume;
b. covering each inclined surface with one or more layers of sheet material;
c. creating or placing at least one means of flowing liquid and solids out of the system within the at least one trough;
d. depositing a second material on top of the layers and the means of flowing to substantially fill the volume, the second material being discrete pieces creating voids within the volume; and
e. receiving liquids and solids into the system and using the means of flowing to flow the liquids and solids through and out of the volume.

34. The method of claim 33 wherein said first and second materials are solid, porous, or hollow.

35. The method of claim 33 wherein said first and second materials are rock, stone, concrete, asphalt, brick, hollow vessels, or a mixture of these.

36. The method of claim 33 wherein the inclined surface approximates the angle of repose of the first material.

37. The method of claim 33 wherein all or part of the sheet material is geotextile or geomembrane fabric or film.

38. The method of claim 33 wherein all or part of the sheet material is metallic, molded plastic, a composite of reinforcement fiber and binding matrix resin, roof or house waterproofing material, or roofing shingles.

39. The method of claim 33 wherein said means of flowing liquids and solids out of the system is a volume created to accept ingressing liquids and solids and allow them to flow to another location.

40. The method of claim 33 wherein said means of flowing liquids and solids out of the system is a perforated drainpipe, stacked bricks, or corrugated panel.

41. A method of creating and using a stormwater containment system with enhanced flow of solids and liquids through a volume, comprising:

a. depositing a first material into the volume and shaping said first material to form a plurality of inclined surfaces within the volume and to also form at least one trough between adjacent inclined surfaces or inclined surface and volume boundary, the first material being discrete pieces creating voids within the volume;
b. covering each inclined surface with one or more layers of sheet material;
c. creating or placing at least one means of flowing liquid and solids out of the system within the at least one trough;
d. depositing a second material on top of the layers and the means of flowing to substantially fill the volume, the second material being discrete pieces creating voids within the volume; and
e. receiving liquids and solids into the system and using the means of flowing to flow the liquids and solids through and out of the volume.

42. The method of claim 41 wherein said first and second materials are solid, porous, or hollow.

43. The method of claim 41 wherein said first and second materials are rock, stone, concrete, asphalt, brick, hollow vessels, or a mixture of these.

44. The method of claim 41 wherein the inclined surface approximates the angle of repose of the first material.

45. The method of claim 41 wherein all or part of the sheet material is geotextile or geomembrane fabric or film.

46. The method of claim 41 wherein all or part of the sheet material is metallic, molded plastic, a composite of reinforcement fiber and binding matrix resin, roof or house waterproofing material, or roofing shingles.

47. The method of claim 41 wherein said means of flowing liquids and solids out of the system is a volume created to accept ingressing liquids and solids and allow them to flow to another location.

48. The method of claim 41 wherein said means of flowing liquids and solids out of the system is a perforated drainpipe, stacked bricks, or corrugated panel.

49. A method of creating and using a stormwater containment system with enhanced flow of solids and liquids through a volume, comprising:

a. depositing a first material into the volume and shaping said first material to form at least one inclined surface within the volume and to also form at least one trough between adjacent inclined surfaces or inclined surface and volume boundary, the first material being discrete pieces creating voids within the volume;
b. covering each inclined surface with one or more layers of sheet material;
c. creating or placing at least one means of flowing liquid and solids out of the system within the at least one trough;
d. depositing a second material on top of the layers and the means of flowing to substantially fill the volume, the second material being discrete pieces creating voids within the volume; and
e. receiving liquids and solids into the system and using the means of flowing to flow the liquids and solids through and out of the volume.

50. The method of claim 49 wherein said first and second materials are solid, porous, or hollow.

51. The method of claim 49 wherein said first and second materials are rock, stone, concrete, asphalt, brick, hollow vessels, or a mixture of these.

52. The method of claim 49 wherein the inclined surface approximates the angle of repose of the first material.

53. The method of claim 49 wherein all or part of the sheet material is geotextile or geomembrane fabric or film.

54. The method of claim 49 wherein all or part of the sheet material is metallic, molded plastic, a composite of reinforcement fiber and binding matrix resin, roof or house waterproofing material, or roofing shingles.

55. The method of claim 49 wherein said means of flowing liquids and solids out of the system is a volume created to accept ingressing liquids and solids and allow them to flow to another location.

56. The method of claim 49 wherein said means of flowing liquids and solids out of the system is a perforated drainpipe, stacked bricks, or corrugated panel.

57. A method of creating and using a stormwater containment system with enhanced flow of solids and liquids through a volume, comprising:

a. depositing a first material into the volume and shaping said first material to form at least one inclined surface within the volume and to also form at least one trough between adjacent inclined surfaces or inclined surface and volume boundary, the first material being discrete pieces creating voids within the volume;

b. covering each inclined surface with one or more layers of sheet material;

c. creating or placing at least one means of flowing liquid and solids out of the system within the at least one trough;

d. depositing a second material on top of the layers and the means of flowing to substantially fill the volume, the second material being discrete pieces creating voids within the volume; and e. receiving liquids and solids into the system and using the means of flowing to flow the liquids and solids through and out of the volume.

58. The method of claim 57 wherein said first and second materials are solid, porous, or hollow.

59. The method of claim 57 wherein said first and second materials are rock, stone, concrete, asphalt, brick, hollow vessels, or a mixture of these.

60. The method of claim 57 wherein the inclined surface approximates the angle of repose of the first material.

61. The method of claim 57 wherein all or part of the sheet material is geotextile or geomembrane fabric or film.

62. The method of claim 57 wherein all or part of the sheet material is metallic, molded plastic, a composite of reinforcement fiber and binding matrix resin, roof or house waterproofing material, or roofing shingles.

63. The method of claim 57 wherein said means of flowing liquids and solids out of the system is a volume created to accept ingressing liquids and solids and allow them to flow to another location.

64. The method of claim 57 wherein said means of flowing liquids and solids out of the system is a perforated drainpipe, stacked bricks, or corrugated panel.

* * * * *